US006257552B1

(12) United States Patent
Crow et al.

(10) Patent No.: US 6,257,552 B1
(45) Date of Patent: Jul. 10, 2001

(54) ARRANGEMENT FOR HANDLING A LOAD

(75) Inventors: Perry A. Crow, Lawson; Gregory C. Brucker, Savannah, both of MO (US); Leif Andersson, Eskilstuna (SE)

(73) Assignees: Gray Automotive Products, Inc., St. Joseph, MO (US); Nike Hydraulics AB, Eskilstung (SE)

( * ) Notice: Subject to any disclaimer, the term of this patent is extended or adjusted under 35 U.S.C. 154(b) by 0 days.

(21) Appl. No.: 09/395,582

(22) Filed: Sep. 14, 1999

(30) Foreign Application Priority Data

Sep. 15, 1998 (SE) ..... 9803114

(51) Int. Cl.[7] ..... B66F 3/00
(52) U.S. Cl. ..... 254/2 B; 254/134
(58) Field of Search ..... 254/133 R, 134, 254/2 B, DIG. 1, 8 B, DIG. 16

(56) References Cited

U.S. PATENT DOCUMENTS 2,838,278 * 6/1958 Johnsen ..... 254/134
3,949,976 * 4/1976 Cofer ..... 254/2 B
4,066,243 * 1/1978 Johnson ..... 254/133 R
4,479,634 * 10/1984 Blatz ..... 254/133 R
4,553,727 * 11/1985 Arzouman ..... 254/1
5,779,225 * 7/1998 Trost ..... 254/133 R

* cited by examiner

*Primary Examiner*—Robert C. Watson
(74) *Attorney, Agent, or Firm*—Shook, Hardy & Bacon L.L.P.

(57) ABSTRACT

An arrangement for handling a load, such as an automotive component or the like, includes a jack assembly 12, a stand 16, and a platform assembly 14 that can be secured to the load and transferred between the jack assembly and stand. The jack assembly 12 includes a wheeled base supporting a piston-and-cylinder assembly. The stand 16 includes a beam 114 supported on a column 116 for relative height adjustment, and a docking tube 110 or the like supported at a free end of the beam. The platform assembly 14 presents a receiver block 48 sized for receipt on a receiver pin 46 of the jack assembly, and a docking pin 108 or the like sized for receipt in the docking tube 110 of the stand. As such, the load can be secured to the platform assembly and transferred between the jack assembly and the stand so that the load can be serviced and replaced.

12 Claims, 5 Drawing Sheets

ARRANGEMENT FOR HANDLING A LOAD

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to an arrangement for handling a load, preferably a drive train or other vehicle component, the arrangement including a movable jack assembly for transferring the load to and from the vehicle, a stand for receiving the load from the jack assembly, and a platform assembly adapted to be secured to the load for supporting the load on the jack assembly and stand.

Conventionally, in the handling of cars having rear wheel drives, a jack assembly is used which includes a universal lift head for removing and transporting the engine and gear box of the car separately to and from a stand or work bench. However, it has become customary to use front wheel drives for cars, where the engine, the gear box, and the front axle are integrated into a single unitary drive train assembly that is supported on an auxiliary frame of the car. As such, there is a need for a handling arrangement for moving these types of drive train assemblies to and from a stand or work bench as a unit.

BRIEF SUMMARY OF THE INVENTION

It is an object of the invention to provide a load handling arrangement that overcomes the technical problems existing in conventional arrangements, and facilitates the removal, service, and replacement of automotive components and the like.

In accordance with these and other objects evident from the following description of a preferred embodiment of the invention, an arrangement is provided that includes a jack, a platform assembly, and a stand. The jack includes a wheeled base and a piston-and-cylinder assembly supported on the base. The piston-and-cylinder assembly is shiftable between a retracted, lowered position and an extended, raised position, and includes an upper end presenting a first receiving structure. The platform assembly includes a second receiving structure adapted for receipt on the first receiving structure, a first docking component, and a mounting structure adapted for connection to the load. The stand includes a second docking component adapted for receipt of the first docking component of the platform such that the platform assembly and load can be transferred between the jack and the stand.

The platform assembly preferably permits adjustment in order to connect to and support any of several different types of components to be serviced, and the jack assembly and stand are particularly adapted for the use with the platform assembly.

The stand can be designed in different ways. Preferably, it includes a substantially vertical column which may be attached to the floor of the repair shop, and a beam movable vertically along and lockable to the column. The second docking component of the arrangement preferably includes a docking tube secured to a free end of the beam, and the first docking component is a docking pin sized for receipt in the tube. For its attachment to the platform assembly, the first docking component can be provided with attachment pins which are substantially perpendicular to the docking pin and are intended for insertion in two corresponding bores in a receiver block forming a part of the platform assembly. A removable locking pin can be used for releasably locking the attachment pins to the receiver block.

By providing an arrangement in accordance with the present invention, numerous advantages are realized. For example, by providing an arrangement in which a component is secured on a platform assembly that may be easily transferred between a jack and a stand, it is possible to first remove a drive train or other component from a vehicle by employing the jack assembly fitted with the platform assembly, and subsequently transfer the component and platform assembly to the stand for service. At the same time, transfer of the component to the stand frees the jack assembly for other duty, for example to raise or lower the beam of the stand to a desired height for work on the load and/or to be equipped with another platform assembly for removing another drive train or component from a vehicle.

BRIEF DESCRIPTION OF THE SEVERAL VIEWS OF THE DRAWING

The invention will be described in further detail below with reference to the accompanying drawing, wherein.

DETAILED DESCRIPTION OF THE INVENTION

Figure 2:
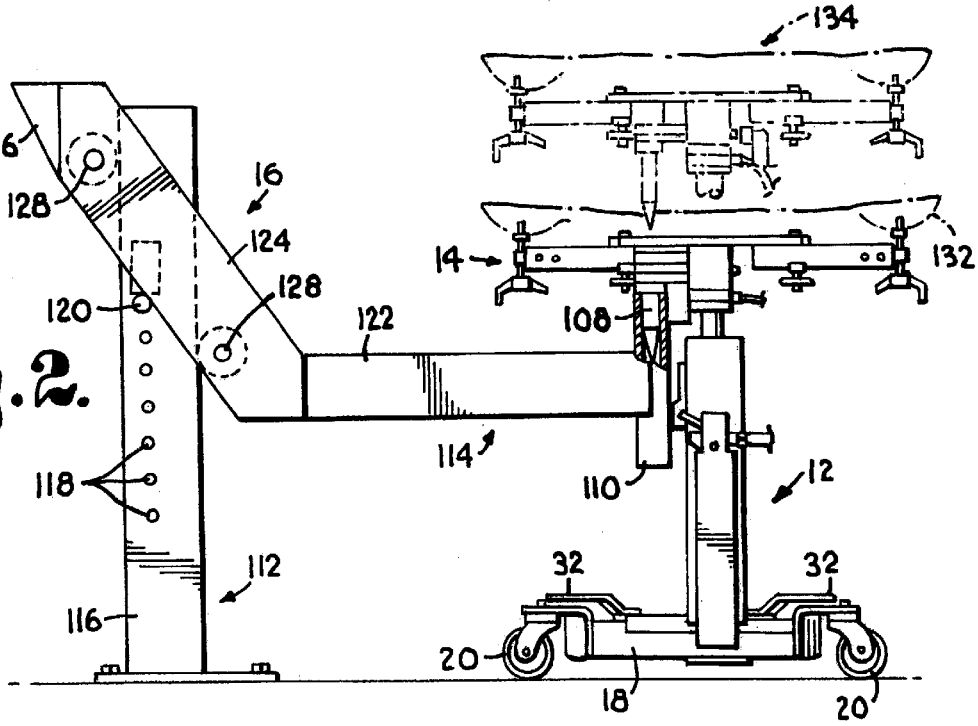
FIG. 2 is a side elevational view of the arrangement.

In accordance with the preferred embodiment, an arrangement for handling a load is illustrated in FIG. 2, and broadly includes a jack assembly 12, a platform assembly 14, and a stand 16.

Figure 1:
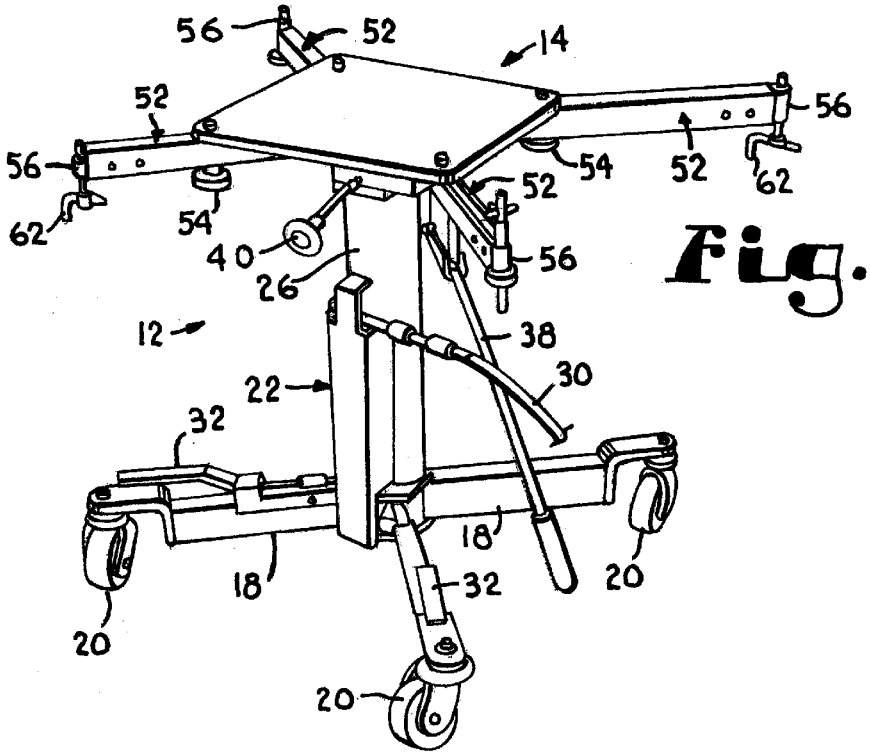
FIG. 1 is a perspective view of a jack assembly and platform assembly forming a part of a load handling arrangement constructed in accordance with the preferred embodiment of the present invention.

The jack assembly is illustrated in FIG. 1, and includes a base defined by a plurality of legs 18, and a piston-and-cylinder assembly secured to and extending upward from the legs. Castors 20 are provided on the legs for supporting the jack assembly for rolling movement across a support surface such as the floor of a service garage, and wheel locks may be provided for locking the castors in any desired position to prevent subsequent movement of the assembly.

Figure 3:
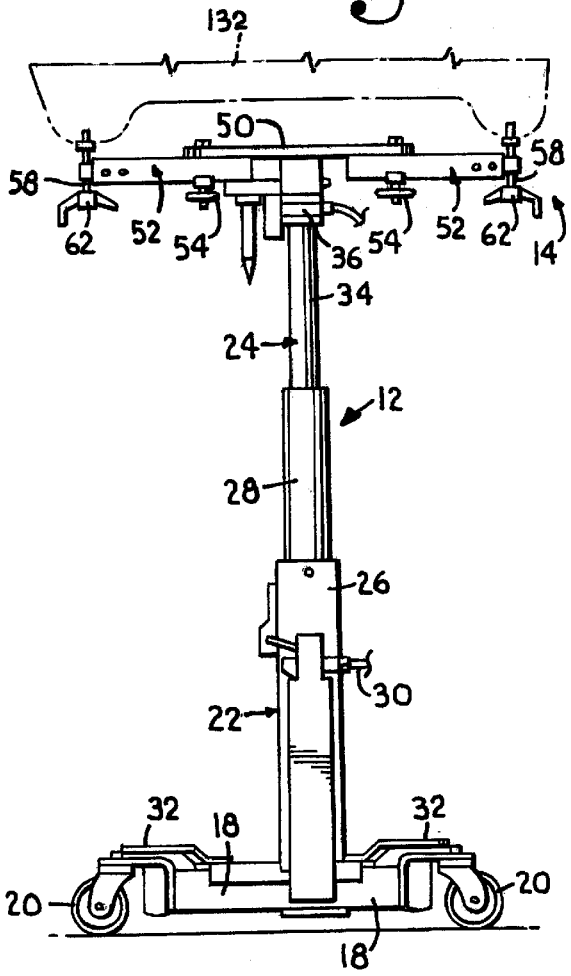
FIG. 3 is a side elevational view of the jack and platform assemblies, illustrating the jack assembly in an extended, raised position.

The piston-and-cylinder assembly is shown in FIG. 3, and includes two stages, a lower pneumatic stage 22 and an upper hydraulic stage 24. The pneumatic stage 22 includes an air cylinder 26 mounted on the base, and a piston 28 received in the cylinder for axial shifting movement between a retracted lowered position and an extended, raised position. In order to extend the piston 28, air is forced into the cylinder 26 under pressure through an air hose 30 from a suitable source of compressed air. To lower the piston, air is exhausted. Pedals 32 are provided on two of the legs of the base for controlling air flow to and from the cylinder.

The hydraulic stage 24 is arranged on top of the pneumatic stage, and includes a cylinder defined by the pneumatic piston 28, a hydraulic piston 34 received in the cylinder for movement between a retracted lowered position and an extended, raised position, and a hydraulic control unit 36 disposed on top of the hydraulic piston. As shown in FIG. 1, the hydraulic control unit 36 includes a hand-actuated pump 38 and a hydraulic valve 40. In order to extend the hydraulic piston, the valve 40 is turned clockwise and the pump 38 is repeatedly actuated until the desired amount of extension is obtained. In order to lower the hydraulic piston, the valve 40 is slowly turned counterclockwise to release pressure from the hydraulic cylinder until the desired amount of retraction is obtained. The arrangement allows fine adjustments in the height of the jack assembly to be made.

Figure 7:
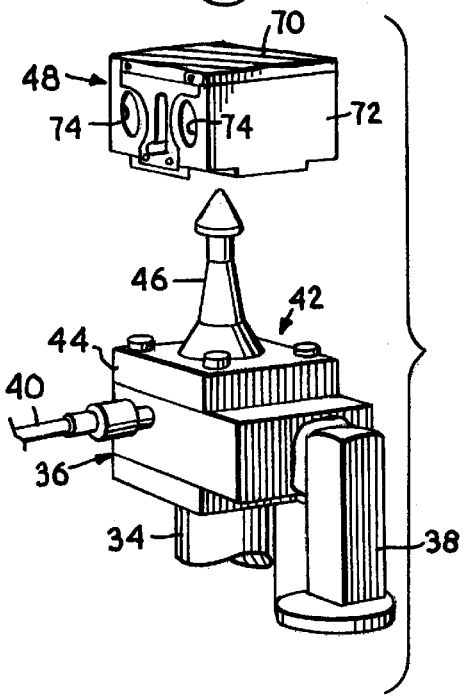
FIG. 7 is an exploded fragmentary perspective view of a first receiving structure provided on the upper end of the jack assembly and a second receiving structure of the platform assembly.

As shown in FIG. 7, a first receiving structure 42 is provided on the upper end of the jack assembly, and includes a lower block 44 presenting vertical holes by which the block is secured to the hydraulic control unit 36, and an upstanding receiver pin 46. The block 44 presents a planer upper bearing surface adapted to receive a second receiving structure 48 that is secured to the platform assembly 14. The pin 46 includes a lower tapered region, an intermediate tapered region, an upper cylindrical throat, and a head. The lower tapered region includes a shape corresponding to that of a truncated cone, and is tapered at an angle, e.g. 45°, that is greater than the angle at which the intermediate region is tapered. The intermediate region is illustrated as being tapered between the lower tapered region and the cylindrical throat. However, it is possible to simply taper the lower region to an upper diameter equal to that of the throat, and to eliminate the intermediate tapered region.

The head of the receiver pin 46 includes a pointed tip for guiding intrusion of the pin in the second structure, and a radiused outer circumferential edge presenting a diameter closely corresponding to the internal diameter of a bore defined by the second receiving structure. The throat of the pin 46 includes a diameter substantially smaller than the diameter defined by the head, and is sized to accommodate a locking mechanism of the second receiving structure, as described below. For providing stability, the length of the receiver pin is considerable in relation to the diameter of the head. This design also provides ease of alignment, and ease of separation with no binding.

Returning to FIG. 3, the platform assembly 14 includes a plate 50, a receiver block defining the second receiving structure 48, and four mounting arm assemblies 52 that, together with the plate 50, define a mounting structure by which the platform assembly can be connected to a vehicle component or other load to be handled. The plate 50 is generally square, presenting a substantially planer upper surface and including holes at the comers by which the mounting arm assemblies 52 are connected to the plate. As shown in FIG. 1, the mounting arm assemblies each include two strips of metal that are spaced laterally from one another and connected at the ends by end pieces. The strips of each arm are spaced from one another by a distance adapted to accommodate a threaded fastener 54 such that the arm can be secured to the plate at one of the comer holes, and the fastener 54 is free to slide within the space relative to the strips, allowing the arm to be extended, retracted and pivoted relative to the plate. Once the arm is properly positioned for a particular application, the fastener 54 is tightened to secure the arm in place against subsequent movement.

Figure 5:
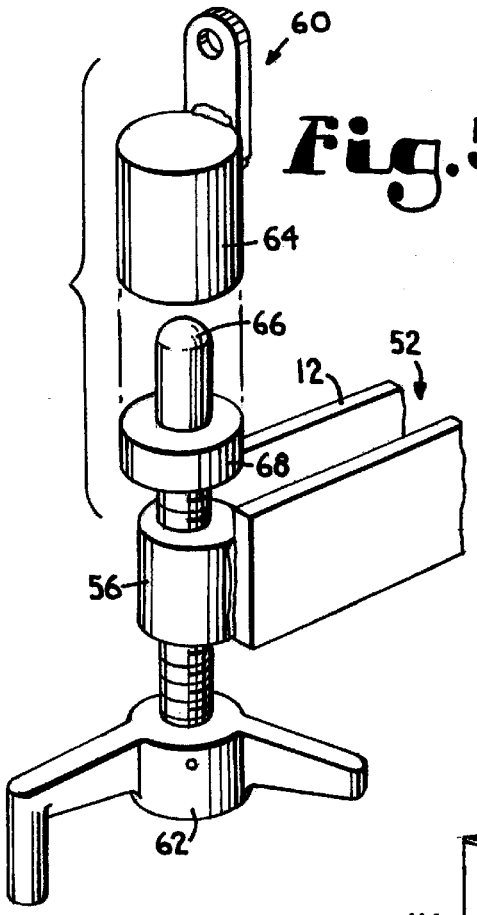
FIG. 5 is an exploded fragmentary perspective view of a mounting structure forming a part of the platform assembly.

As shown in FIG. 5, the outer end piece 56 of each mounting arm assembly includes a vertical threaded hole sized for receipt of a threaded rod 58 forming a part of a pad assembly 60. Each pad assembly 60 also includes a hand knob 62 secured to the threaded rod 58 for permitting rotation thereof, and an adaptor 64 received on the upper end of the threaded rod. Preferably, the upper end of the threaded rod includes a cylindrical post 66 on which the adaptor is received, and a flange 68 that supports the adapter on the post. The adaptor 64 may take any desired form, and is easily removable from the post of the pad assembly so that a suitable adaptor may be employed for a particular component or load. Although any particular adaptor may have utility with more than one type of load, it is possible that new adaptors might be required for a particular load, and the construction of the pad assembly permits the use of such adaptors without requiring modification to the entire assembly.

By adjusting the angle and extension of the mounting arm assemblies 52 relative to the plate, and by mounting suitable adaptors on the pad assemblies 60 and adjusting the heights of the adaptors relative to the plate, it is possible to align the platform assembly with the load to be handled so that the center of gravity of the load is closely centered over the center of the plate, and thus over the longitudinal axis of the jack assembly during transfer.

Figure 11:
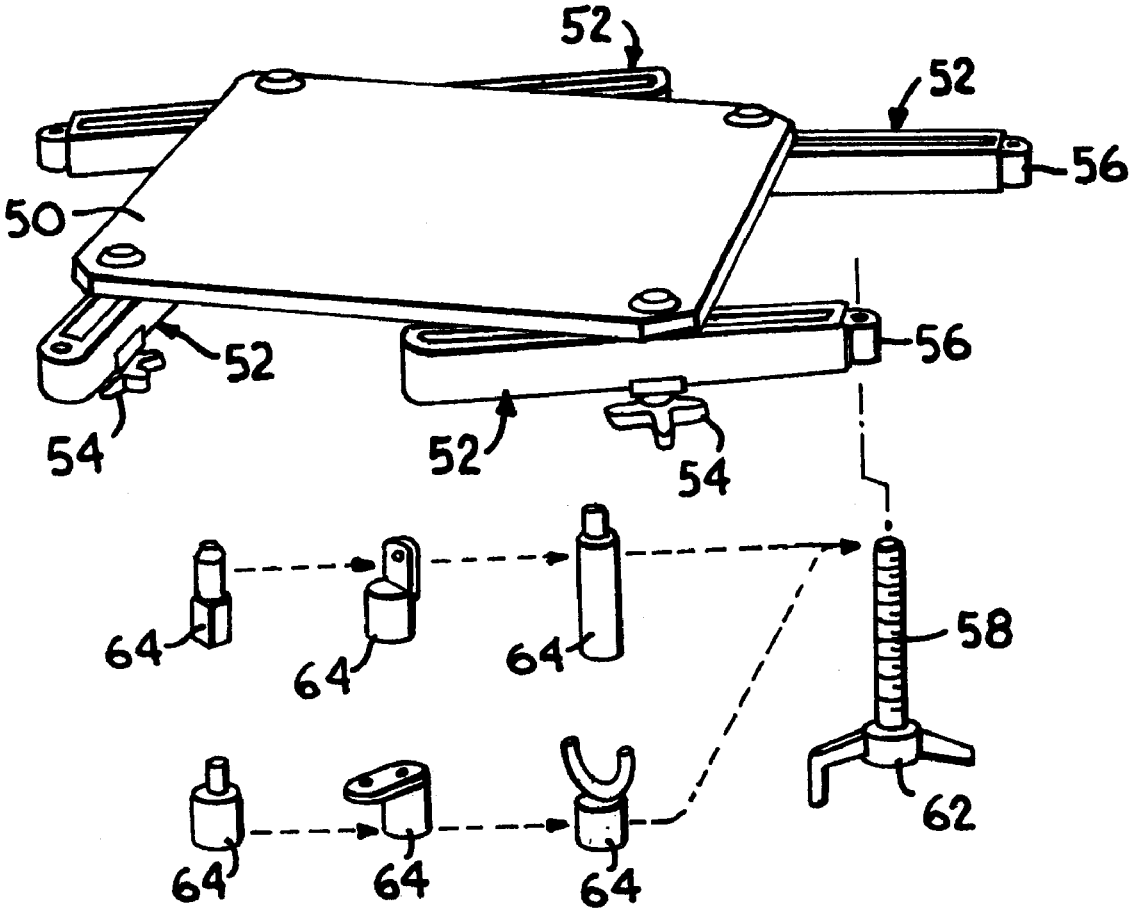
FIG. 11 is a fragmentary exploded view of a plurality of mounting arm assemblies forming a part of the platform assembly.

Turning to FIG. 11, an alternate construction of the pad assembly 60 is illustrated. In the construction shown in FIG. 11, each pad assembly 60 includes a hand knob 62 secured to the threaded rod 58 for permitting rotation thereof, and an adaptor 64 received on the upper end of the threaded rod. Unlike the construction illustrated in FIG. 5, the threaded rod 58 in the construction of FIG. 11 does not include a cylindrical post or flange at the upper end thereof. Rather, the adaptor 64 is received directly on the upper end of the threaded rod 58.

The adaptors 64 illustrated in FIG. 11 take several different forms, each of which is threaded or otherwise adapted for receipt on the upper end of the threaded rod 58 so that the adaptors can be interchanged with one another depending on the application to which the apparatus is being put. As mentioned previously, although various adaptors are illustrated for use in connection with the pad assemblies 60, other adaptors may also be developed in order to permit use of the apparatus with any particular type of load.

Figure 8:
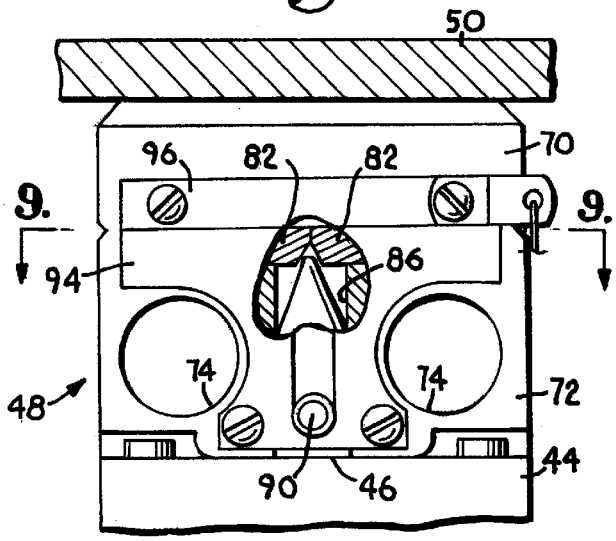
FIG. 8 is a fragmentary elevational view of the first and second receiving structures in an engaged and locked position.
Figure 10:
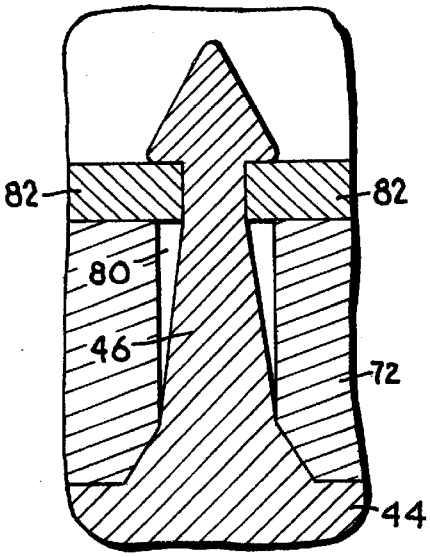
FIG. 10 is a fragmentary sectional view taken along line 10—10 of FIG. 9.

The receiver block 48 is shown in FIG. 8, and broadly includes a two-piece construction comprised of upper and lower block elements 70, 72 that are welded or otherwise affixed to one another during manufacture. In addition, the block includes a locking mechanism for locking the receiver pin and block together to secure the platform assembly to the jack assembly.

Figure 9:
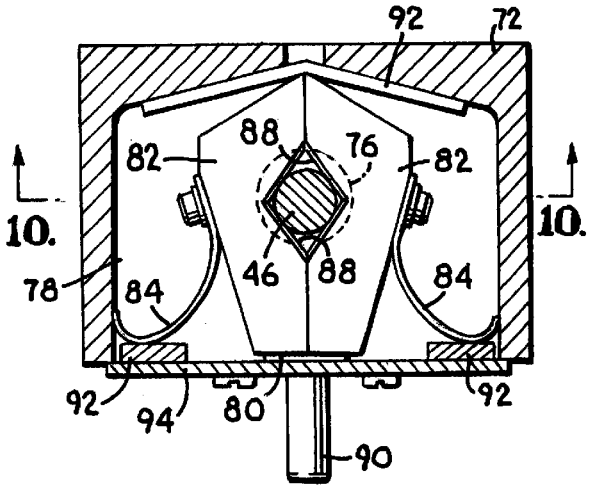
FIG. 9 is a sectional view of the first and second receiving structures taken along line 9—9 of FIG. 8.

The lower block element 72 is preferably formed from a solid piece of metal and includes a pair of bores 74 extending through the element adjacent the bottom thereof. The two bores are parallel to and spaced laterally from one another, and are disposed in a substantially horizontal plane when the platform assembly is received on the jack assembly. As shown in FIG. 9, a vertical bore 76 extends through the lower element between the two horizontal bores, and is sized for receipt of the receiver pin when the block is lowered onto the jack assembly. A lower portion of the bore is tapered to receive the tapered lower region of the receiver pin such that the bottom surface of the receiver block engages and is supported on the upper surface of the first receiving structure of the jack assembly. As illustrated in FIG. 7, cutouts are provided on the bottom of the lower element at the corners thereof for accommodating the heads of the threaded fasteners used to secure the block 44 to the hydraulic control unit of the jack assembly 12.

As shown in FIG. 9, the vertical bore 76 communicates with a central cavity 78 that is formed in the upper end of the lower element. The central cavity 76 is spaced inward from three of the walls of the lower element, and extends completely to the front edge of the element. An additional channel 80 is formed in the front of the lower element, and communicates with the central cavity at the upper end of the channel.

The locking mechanism includes a pair of jaws 82 positioned in the central cavity, a pair of leaf springs 84 that bias the jaws shut, and a release shuttle 86 disposed in the channel 80 for engaging the jaws and opening them against the bias of the springs. The jaws 82 each present a substantially straight inner edge adapted to bear against the inner edge of the opposed jaw in the closed position of the jaws, a first end that is pointed at the inner edge to define a pivot axis of the jaw, and an outer edge to which one of the springs 84 is attached. The inner edge of each jaw 82 includes a central V-shaped notch 88 that protrudes into the jaw from the inner edge, and the notches of the two jaws are aligned so that a generally diamond-shaped nip is defined between the jaws within which the throat of the receiver pin 46 is received when the platform assembly is fitted on the jack assembly. In the closed position of the jaws 82, the nip is sized smaller than the outer-edge diameter of the head of the pin 46 so that the pin cannot be removed from the receiver block. However, when the jaws are separated from one another, the nip opens to a size that permits the passage of the head of the pin in either direction.

The release shuttle 86 is received in the channel 80 for sliding movement between a lower position out of engagement with the jaws, as shown in FIG. 8, and a raised position engaging the jaws. The shuttle presents a pointed, arrow-shaped upper end, and the inner edges of the jaws are tapered to receive the shuttle such that when the shuttle is raised into engagement with the jaws, it forces the jaws apart to the open position. A small handle 90 protrudes from the shuttle for facilitating gripping and movement of the shuttle, and the springs 84 bias the shuttle to the lower position so that once the jaws have been opened for release of the platform assembly from the jack assembly, the jaws and shuttle are returned to the normal closed position by the springs. In order to lock the receiver block 48 on the receiver pin 46, the head of the pin engages the nip of the jaws 82 and forces them apart in much the same way as does the shuttle. Once the head of the pin 46 passes over the jaws, the jaws are pushed together by the springs 84 and engage the throat of the pin, preventing subsequent removal.

As illustrated in FIG. 9, bearing pads 92 may be provided in the lower block element for supporting the jaws and springs. In addition, a face plate 94 is secured to the front of the lower block element over the channel to retain the shuttle in place on the block. The face plate includes a vertical slot through which the handle 90 protrudes, and two of the bearing pads 92 for the springs are supported on the inside of the face plate. As shown in FIG. 8, a small strip of metal 96 can be secured to the block above the face plate for supporting a locking pin or the like that is used to secure the block to a docking component as described below.

The upper element 70 of the block 48 covers the central cavity of the lower element 72 and encloses the jaws and springs of the locking mechanism. The upper element includes a central vertical bore that is collinear with the vertical bore in the lower element, and accommodates the head of the pin when the platform assembly is secured to the jack assembly. The upper element is secured to the lower element by welding or other means, and is also welded or otherwise affixed to the underside of the plate. As such, the block 48 remains with the platform assembly as the assembly is transferred between the jack assembly and the stand.

Figure 6:
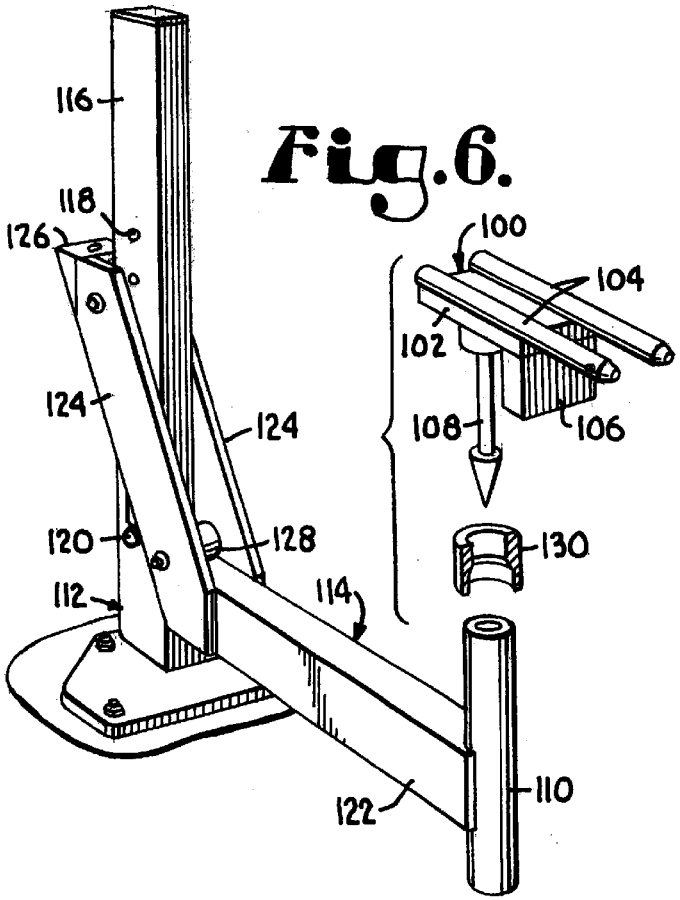
FIG. 6 is an exploded perspective view of the stand and a docking component of the platform assembly.

With reference to FIG. 6, in order to permit the platform assembly 14 to be transferred between the jack assembly and the stand 16, a first docking component 100 is provided that is mounted on the platform assembly and adapted for receipt by the stand. The first docking component includes a block of metal 102 to which a pair of laterally spaced, horizontally extending parallel pins 104 are welded or otherwise secured. The pins protrude from one end of the block, and are arranged and sized for receipt in the two bores 74 in the lower element of the receiver block of the platform assembly, shown in FIG. 8. At least one of the pins includes a transverse hole adjacent the free end thereof which is sized for receipt of the locking pin supported by strip 96.

Returning to FIG. 6, an end plate 106 is welded to the same end of the block from which the pins protrude, and depends downward from the block to define a bearing surface against which the receiver block 48 bears when the first docking component is fitted on the platform assembly. As such, the end plate positions the docking component relative to the platform assembly, and prevents it from twisting relative to the assembly during use of the arrangement.

A docking pin 108 depends from the block and includes a large-diameter upper section, a cylindrical intermediate section, and a lower head. The upper section is generally cylindrical, and presents a lower shoulder that is tapered slightly to facilitate placement and removal of the docking pin in the stand. The intermediate section is elongated, providing good stability to the coupling when the pin is positioned in a second docking component provided on the stand, and preferably includes a length substantially greater than the diameter of the pin.

The head of the pin 108 resembles the head of the receiver pin 46, and includes a pointed tip for guiding intrusion of the pin in the second docking structure, and a radiused outer circumferential edge presenting a diameter closely corresponding to the internal diameter of a second docking component 110 forming a part of the stand. The diameter of the radiused outer circumferential edge of the head is preferably slightly larger than the diameter of the intermediate section so that the only contact between the second docking structure and the lower sections of the pin is at the radiused edge of the head. This construction prevents the pin from binding, and facilitates placement and removal of the platform assembly from the stand.

The stand 16 is shown in FIG. 6, and broadly includes a base 112, a beam 114 supported on the base for relative vertical movement between a plurality of positions, and a docking tube 110 secured to an end of the beam and defining the second docking structure that cooperates with the docking pin 108 to support the platform assembly on the stand.

The base 112 includes a generally flat plate adapted to be fastened to the floor of a service garage or the like, and an upstanding post or column 116 welded or otherwise secured to the plate. The column is preferably of square tubular construction, and includes a plurality of vertically spaced, horizontally extending holes 118 formed in opposite sides thereof for receiving a positioning pin 120. The two remaining sides of the column define bearing surfaces against which the beam bears to support the beam on the column.

The beam 114 includes a square tubular lift arm 122 presenting opposed ends. At one end of the lift arm, a pair of laterally spaced mounting arms 124 are provided. The mounting arms protrude axially from the first end of the lift arm, and are angled upward, presenting upper ends that are connected together by a saddle 126. The column 116 is received between the arms 124 of the beam between the lift arm and the saddle, and the mounting arms 124 include inner surfaces that slide along the sides of the column in which the holes are presented. Bearing pads may be provided on the inside of each mounting arm to facilitate this sliding movement, if desired.

As shown in FIG. 2, a pair of rollers 128 are secured between the mounting arms 124 and are spaced from one another by a distance adapted to accommodate receipt of the column therebetween. The rollers 128 are supported for rotation about their respective axes, and facilitate movement of the beam 114 along the column 116. In addition, because the mounting arms are angled, the rollers 128 are offset both vertically and horizontally from one another, stabilizing movement of the beam along the column.

The second end of the lift arm is welded or otherwise secured to the docking tube 110. The docking tube is an elongated cylindrical tube presenting an upper end that includes a shallow taper to receive the tapered shoulder of the docking pin 108. In addition, the docking tube presents an inner diameter that is closely matched to the maximum diameter presented by the head of the docking pin so that the two elements do not bind during placement or removal, but also do not permit substantial play between the platform assembly and the stand. A collar 130 may be provided for placement on the upper end of the docking tube. The collar presents an inner diameter that is stepped slightly so that the collar fits on top of the docking tube and receives the upper section of the docking pin, removing play from the connection between the pin and tube.

Figure 4:
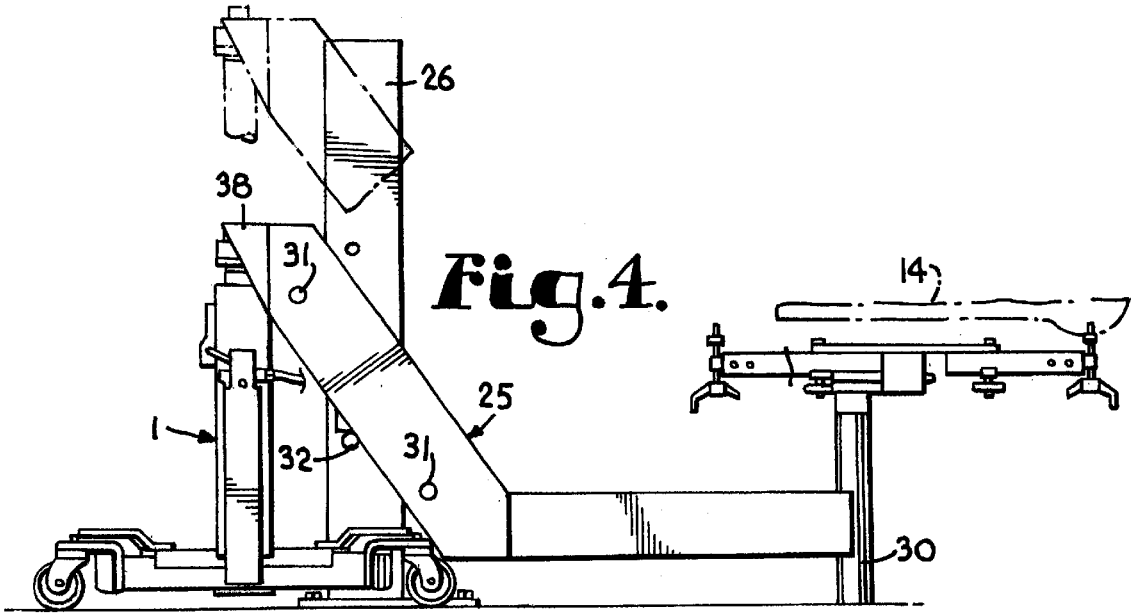
FIG. 4 is a side elevational view of the arrangement, illustrating a stand of the arrangement in a lowered position and the jack assembly engaged with the stand.

With reference to FIG. 4, in order to adjust the height of the beam 114 on the column 116, the beam is raised or lowered to the desired height, and the positioning pin 120 is inserted into the holes immediately below the mounting arms of the beam. Thereafter, the beam is lowered into contact with the positioning pin and is retained in that vertical position. The saddle 126 is provided for permitting a jack, such as the jack assembly 12, to be positioned beneath the saddle and to carry out the raising or lowering of the beam to any desired position.

Turning to FIG. 3, with the platform assembly 14 secured to the jack assembly 12, the jack assembly is moved into position beneath a vehicle, and the pneumatic stage 22 is actuated to raise the platform assembly into close proximity with the drive train or other vehicle component 132 to be removed. The hydraulic stage 24 of the jack assembly is then actuated, if necessary, to carry out fine adjustment in the position of the platform assembly relative to the vehicle, and the mounting arm assemblies 52 are manipulated to permit attachment of the lift pad assemblies to the vehicle component.

With the vehicle component secured to the mounting arm assemblies of the platform assembly, the jack assembly is lowered, first be lowering the hydraulic stage, and then by lowering the pneumatic stage.

Once the jack assembly is lowered with the vehicle component supported on the platform assembly, it is rolled from beneath the vehicle to a position adjacent the stand. In order to permit receipt of the platform assembly, the beam is initially positioned at a height above the floor, and the jack assembly is raised slightly from its lowermost position, as shown in broken lines 134 in FIG. 2. Thereafter, the docking pin 108 is aligned with the docking tube 110, and the jack assembly is lowered so that the pin is received in the tube and the weight of the vehicle component and platform assembly is transferred to the stand. The handle of the shuttle on the locking mechanism is lifted to release the jaws, and the jack is lowered still further beyond the position shown in solid lines in FIG. 2, so that the receiver pin drops away from the block, releasing the platform assembly from the jack assembly.

Once the platform assembly 14 is free from the jack assembly, the jack assembly is removed, and the height of the beam 114 can be adjusted by positioning the jack assembly beneath the saddle, as shown in FIG. 4, raising the beam, removing the positioning pin, and then lowering the beam to the desired working height. Preferably, the saddle 126 includes a hole sized for receipt of the receiver pin 46 so that the jack assembly is easily positioned in engagement with the saddle during height adjustment of the beam. Thereafter, the positioning pin 120 is repositioned in the holes beneath the mounting arms, and the jack is lowered so that the beam is supported in the adjusted position. The jack assembly is then free for other duties.

Work can now commence on the drive train at the stand 16, whereas the jack assembly is available to attach another platform assembly or adapter for use elsewhere in the shop. The stand provides a work station for repair and overhaul of the drive train or other vehicle components. The platform assembly is able to rotate about the vertical axis of the docking pin.

To return the vehicle component to the vehicle, the beam 114 is raised to a height at which the jack assembly fits beneath the receiver block 48 of the platform assembly, and the jack assembly is raised into engagement with the receiver block so that the receiver pin separates the jaws and locks the platform assembly in place and lifts the assembly and vehicle component from the stand. Thereafter, the jack assembly is moved into position beneath the vehicle and the pneumatic stage 22 is actuated to lift the vehicle component into place, as shown in FIG. 3. If necessary, the hydraulic stage 24 is then actuated to make fine adjustment to the position of the vehicle component, and the component is re-installed. Subsequently, the platform assembly is detached from the component and the jack assembly is lowered out of the way and removed.

Modifications and substitutions are possible within the scope of the appended claims. It would, for example, be possible to provide the stand with internal means for operating the beam. Also other design changes may be made without departing from the general idea to transmit the drive train to a stand together with a platform assembly adapted for the purpose.

What is claimed is:

1. An arrangement for handling a load, comprising:

a jack including a wheeled base and a piston-and-cylinder assembly supported on the base, the piston-and-cylinder assembly being shiftable between a retracted, lowered position and an extended, raised position and including an upper end presenting a first receiving structure;

a platform assembly including a second receiving structure adapted for receipt on the first receiving structure, a first docking component, and mounting structure adapted for connection to the load; and a stand including a second docking component adapted for receipt of the first docking component of the platform assembly so that the platform assembly and load can be transferred between the jack and the stand, wherein the stand includes a base presenting an upstanding column, and a beam supported on the column for relative vertical movement between raised and lowered positions, the beam including an outer end at which the second docking component is supported.

2. The arrangement as recited in claim 1, wherein the second docking component includes a docking tube secured to the end of the beam, the first docking component including a docking pin that depends from the platform assembly and is sized for receipt in the docking tube.

3. The arrangement as recited in claim 2, wherein the first docking component includes at least one attachment pin extending in a direction substantially perpendicular to the docking pin, the at least one attachment pin being received in the second receiving structure of the platform assembly.

4. The arrangement as recited in claim 3, further comprising a lock for locking the at least one attachment pin in place in the second receiving structure so that the second receiving structure and the first docking component are secured together for movement with the platform assembly.

5. The arrangement as recited in claim 1, wherein the column includes a plurality of vertically spaced holes, the arrangement further comprising a load support pin sized for receipt in any of the holes for adjusting the height of the beam.

6. The arrangement as recited in claim 1, wherein the beam includes a lift point bracket by which the beam can be engaged by the jack lifted relative to the column.

7. An arrangement for handling a load, comprising:

a jack including a wheeled base and a piston-and-cylinder assembly supported on the base, the piston-and-cylinder assembly being shiftable between a retracted, lowered position and an extended, raised position and including an upper end presenting a first receiving structure;

a platform assembly including a second receiving structure adapted for receipt on the first receiving structure, a first docking component, and mounting structure adapted for connection to the load; and a stand including a second docking component adapted for receipt of the first docking component of the platform assembly so that the platform assembly and load can be transferred between the jack and the stand, wherein the platform assembly includes a plate, and the mounting structure includes at least one mounting arm extending from the plate and a removable lift pad assembly supported on the at least one mounting arm at a position spaced from the plate.

8. The arrangement as recited in claim 7, wherein the at least one mounting arm presents an outer end including a threaded bore, and the lift pad assembly includes a threaded rod sized for receipt in the threaded bore, and an interchangeable lift pad secured to the threaded rod.

9. An arrangement for handling a load, comprising:

a jack including a wheeled base and a piston-and-cylinder assembly supported on the base, the piston-and-cylinder assembly being shiftable between a retracted, lowered position and an extended, raised position and including an upper end presenting a first receiving structure;

a platform assembly including a second receiving structure adapted for receipt on the first receiving structure, a first docking component, and mounting structure adapted for connection to the load; and a stand including a second docking component adapted for receipt of the first docking component of the platform assembly so that the platform assembly and load can be transferred between the jack and the stand, wherein the first receiving structure includes a receiver pin protruding from the upper end of the jack assembly, and the second receiving structure includes a receiver block presenting a cavity sized for receipt of the receiver pin.

10. The arrangement as recited in claim 9, wherein the receiver pin includes an enlarged head and a reduced-diameter throat, and the cavity presents a diameter substantially equal to the diameter of the enlarged head.

11. The arrangement as recited in claim 10, wherein the receiver pin includes a base region in which the pin is tapered, and that the cavity in the receiver block includes an outer region that corresponds in shape to the base region of the receiver pin.

12. The arrangement as recited in claim 9, further comprising a locking assembly supported on the receiver block for locking the receiver pin in the cavity so that the platform assembly is secured to the jack, the locking assembly including a release mechanism for releasing the receiver pin so that the platform assembly can be transferred between the jack and the stand.

* * * * *